US005154231A

United States Patent [19]

Bailey et al.

[11] Patent Number: 5,154,231

[45] Date of Patent: Oct. 13, 1992

[54] WHIPSTOCK ASSEMBLY WITH HYDRAULICALLY SET ANCHOR

[75] Inventors: Thomas F. Bailey; John E. Campbell; Larry F. Moeller, all of Houston, Tex.

[73] Assignee: MASX Energy Services Group, Inc., Houston, Tex.

[21] Appl. No.: 585,532

[22] Filed: Sep. 19, 1990

[51] Int. Cl.[5] ..... E21B 7/08; E21B 29/06

[52] U.S. Cl. ..... 166/298; 166/117.6; 166/55.2; 175/81; 175/82

[58] Field of Search ..... 166/297, 117.5, 117.6, 166/55.1, 55.2, 298; 175/61, 79-82

[56] References Cited

U.S. PATENT DOCUMENTS

| | | | |
|---|---|---|---|
| 1,835,227 | 12/1931 | Lane et al. | 166/117.6 |
| 2,227,347 | 12/1940 | Johnson | 166/117.6 |
| 2,509,144 | 5/1950 | Grable et al. | 166/117.6 |
| 2,633,331 | 3/1953 | Hampton | 175/82 |
| 3,095,039 | 6/1963 | Kinzbach | 166/117.6 |
| 4,397,355 | 8/1982 | McLamore | 166/297 |
| 4,765,404 | 8/1988 | Bailey et al. | 166/117.6 |

OTHER PUBLICATIONS

Oil and Gas Journal, p. 108, May 8, 1930.

*Primary Examiner*—Stephen J. Novosad

*Attorney, Agent, or Firm*—Edgar A. Zarins; Malcolm L. Sutherland

[57] ABSTRACT

A one-trip whipstock assembly incorporating a hydraulically set anchor which includes an interlock for maintaining the anchor in its set position upon interruption of hydraulic pressure. The anchor is connected to the lower end of the assembly which also includes a whipstock for diverting cutting tools and a locator sub for positioning the assembly in the cased well bore. The whipstock assembly is designed to be run into the well using a running string or a mill attached to the upper end of the whipstock in order to locate and set the whipstock and mill the casing in only one trip.

14 Claims, 2 Drawing Sheets

WHIPSTOCK ASSEMBLY WITH HYDRAULICALLY SET ANCHOR

BACKGROUND OF THE INVENTION

I. Field of the Invention

This invention relates to whipstock assemblies used in a well and, in particular, to a hydraulically set anchor for use in a whipstock assembly to provide sufficient anchorage to facilitate kick-off from the primary well bore.

II. Description of the Prior Art

Packers and anchors are typically used in well bores to seal off sections of a well and/or to provide support structure for well tools in the production process. Deviating tools, whipstocks, perforating tools, etc. are examples of tools which employ an anchor or packer. In many instances, the anchor/packer is run into the well and set with one trip of the running string and the particular device engaged with the anchor/packer using a second trip of the running string. With the tool supported against the anchor/packer, the particular operation can be conducted.

More recently, in order to reduce production costs, the tool has been combined with the anchor/packer thereby eliminating one trip of the running string. Consequently, the anchor/packer is set in the well using mechanical or hydraulic means extending through the well tool after which the tool is engaged to carry out the operation. Once the operation is completed the anchor/packer is typically abandoned with the well.

In the prior known hydraulically set anchor/packer, the hydraulic pressure may have to be maintained in order to prevent release of the tool. As a result, mechanically set tools are typically used in one-trip combination assemblies since the mechanical set can be maintained following disconnection of the production tool. However, mechanically set anchor/packers are unreliable in high pressure wells because of the extreme setting forces required which cannot be achieved in such tools. Moreover, it has been found that in many applications, the well bore does not need to be sealed-off by packing elements.

SUMMARY OF THE PRESENT INVENTION

The present invention overcomes the disadvantages of the prior known setting tools by providing whipstock assembly incorporating a hydraulically set anchor to provide a supporting surface for continued operations. The anchor of the present invention is adapted to be securely set in the cased well under a minimum of hydraulic pressure as a result of the shallow angle between the slip cones and the associated slip elements.

The single trip whipstock assembly of the present invention facilitates kick-off from the primary well bore with a minimum of trips into the well. The whipstock may be run and set within the hole using a running string or the mill may be attached thereto for positioning the whip and subsequent milling through the casing. In a preferred embodiment of the whipstock assembly, a hydraulically set anchor forms the lower end of the tool which is connected to the whip surface used to divert the milling and drilling tools. Intermediate the anchor and whip is a locator sub having positioning dogs to position the whipstock at the appropriate level within the casing. A locator window is preferably cut in the casing for positioning the whipstock prior to setting the anchor.

The hydraulically set anchor includes an adapter sub for connection to the production tool and which is joined to a mandrel having a partial axial bore forming a fluid passageway. The fluid passageway communicates with a cylinder formed by the annulus surrounding the mandrel within which is movably disposed a piston assembly. The piston assembly engages the movable upper slip cone of the anchoring slip assembly. The lower slip cone is stationary and is secured to the lower end sub of the anchor. The slip elements are circumferentially spaced and extend between the movable upper slip cone and the lower slip cone. The shallow angle between the slips and the slip cones facilitates secure engagement of the slips with the casing. The forces generated by the hydraulic pressure acting on the inner piston of the tool creates a higher setting force which cannot be achieved by prior known mechanically set anchors. Moreover, the mechanical force required to shear the bolts of the tool adds to the hydraulic force to set the anchor.

An interlock assembly maintains the set position of the slip assembly with respect to the casing. In the preferred embodiments, the interlock assembly is associated with the movable upper slip cone and the mandrel such that as the upper slip cone travels along the mandrel the position facilitating anchoring to various casing diameters.

Other objects, features and advantages of the invention will be apparent from the following detailed description taken in connection with the accompanying drawings.

BRIEF DESCRIPTION OF THE DRAWINGS

The present invention will be more fully understood by reference to the following detailed description of a preferred embodiment of the present invention when read in conjunction with the accompanying drawings, in which like reference characters refer to like parts throughout the views and in which.

DETAILED DESCRIPTION OF A PREFERRED EMBODIMENT OF THE PRESENT INVENTION

Figure 1:
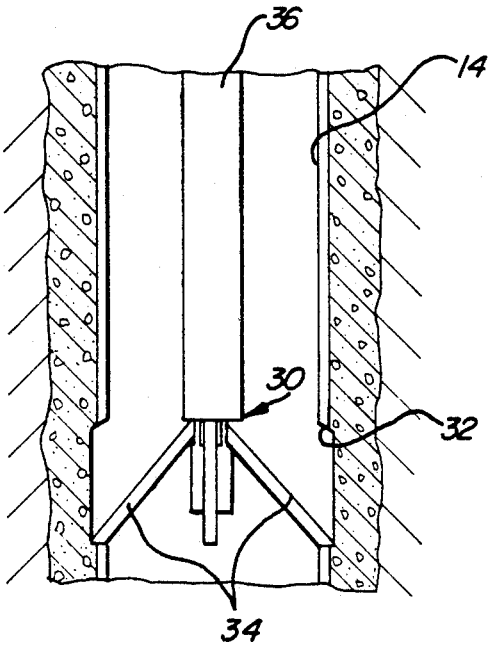
FIG. 1 is a cross-sectional view of the well bore showing a casing cutter forming the locator window within the casing.

Referring to the drawings, there is shown a single-trip whipstock assembly 10 incorporating a hydraulically-set anchor 12 to facilitate diversion of a well bore for continued production. The hydraulically-set anchor 12 secures the whipstock assembly 10 within the well bore 14 such that a milling tool 16 can be used to mill through the casing. The anchor 12 includes means to prevent release when the hydraulic fluid pressure is interrupted during the milling process. As a result, the entire assembly 10 can be run into the well bore 14, set in the well bore 14 and the milling process initiated in a single trip of the tool as will be subsequently described in greater detail.

Figure 5:
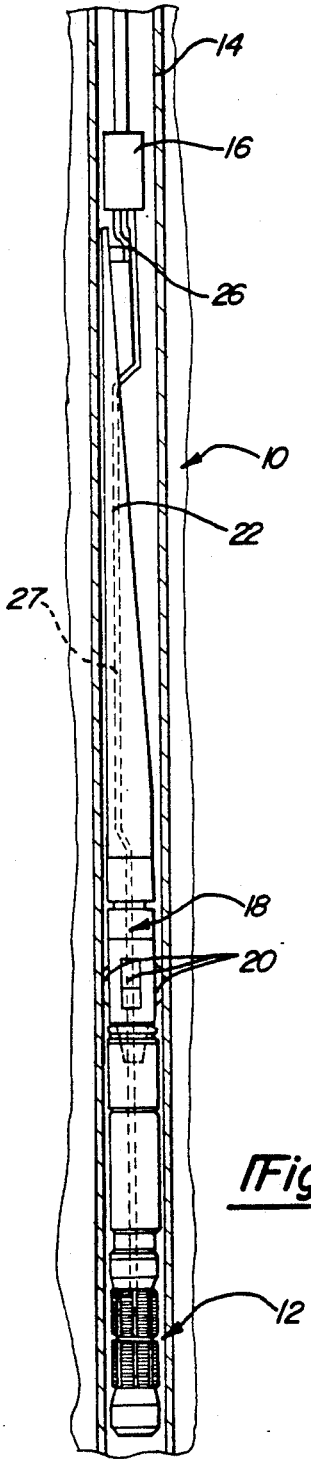
FIG. 5 is a cross-sectional view of the well bore showing a second embodiment of the single-trip whipstock assembly positioned in the well bore.

In a preferred embodiment of the present invention, the whipstock assembly 10 comprises the anchor 12, a locator sub 18 with outwardly biased locator dogs 20, a whip 22 and a running tool such as a running string 24 (FIG. 3) or the mill 16 (FIG. 5) detachably secured to the whip 22. In the event positioning of the whipstock assembly 10 is less critical, the locator sub 18 may be eliminated. The running string 24 or mill 16 includes means for supplying hydraulic fluid to the whipstock assembly 10 through the detachable fluid hose 26 and passageway 27 in the whip 22 which communicate with a fluid passageway 28 extending through the assembly 10 to communicate with the anchor 12. The fluid pressure required to set the whipstock assembly 10 is supplied through the running string and fluid passageway 28. Once the anchor 12 is pressurized through hose 26 and passage 27, the hose 26 can be disconnected from the whip 22 through rotation or tension upon the running string 24. Interlock means in the anchor 12 prevents release once hydraulic fluid pressure in interrupted.

Figure 2:
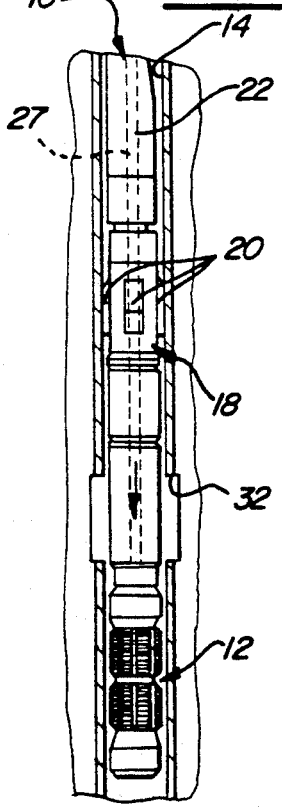
FIG. 2 is a cross-sectional view of the well bore showing the whipstock assembly of the present invention being run into the well bore.
Figure 4:
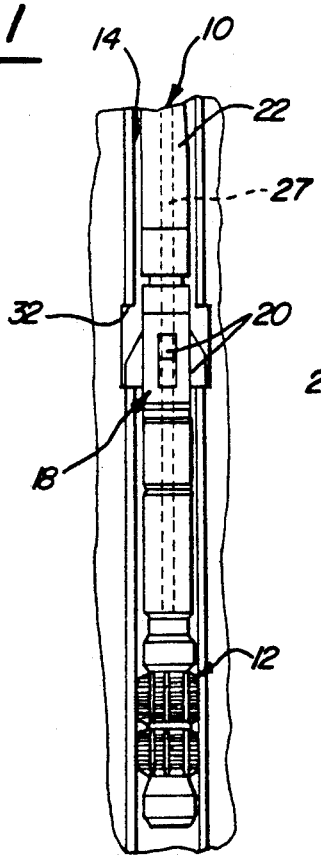
FIG. 4 is a cross-sectional view of the well bore showing the whipstock anchor set in the well bore.
Figure 3:
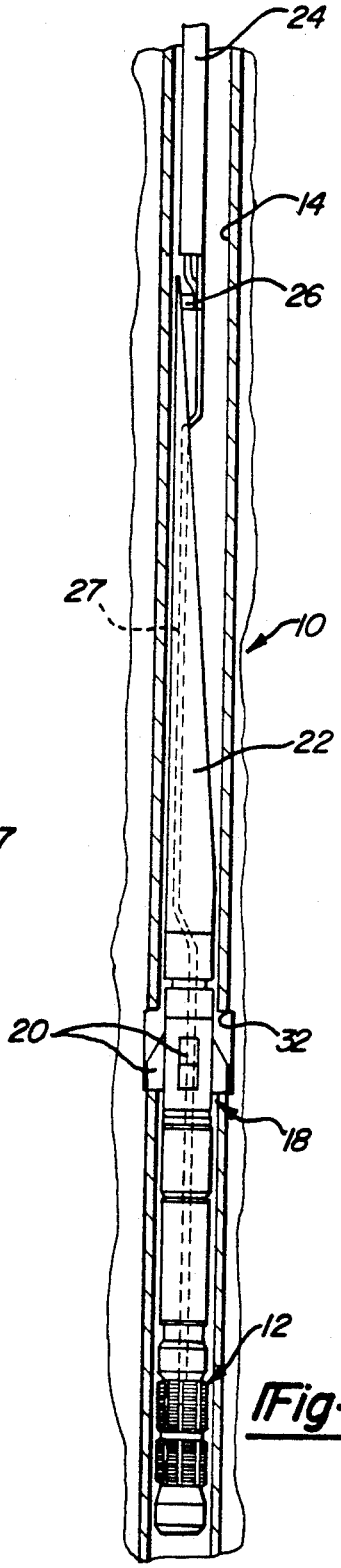
FIG. 3 is a cross-sectional view of the well bore showing a first embodiment of the single-trip whipstock assembly positioned in the well bore.

The whipstock assembly 10 of the present invention facilitates diversion of the well bore in a single trip of the tool thereby reducing operating costs in contrast to prior known diversion techniques which employ separate anchors, whips and/or milling tools. Once the depth of the diversion is determined, a casing cutter 30 can be run into the well bore 14 to form a positioning window 32 for the locator sub 18. The cutter 30 includes at least one expandable cutting arm 34. Upon engagement of the cutter 30 the string 36 is rotated to cut the window 32 in the casing. Of course, in less critical operations, the locator sub 18 may be omitted from the assembly 10 which would eliminate the need to form the window 32. The whipstock assembly 10 is run into the well bore 14 with the anchor 12 unset and the locator dogs 20 retracted but engaging the casing as shown in FIG. 2. The whipstock assembly 10 is run into the well bore 14 until the locator dogs 20 can expand outwardly into the window 32 as shown in FIG. 3. The dogs 20 will prevent the assembly 10 from being run any further into well bore 14. However, should the assembly 10 need to be removed or repositioned prior to setting, the angled upper edges of the dogs 20 will force the dogs 20 inwardly upon lifting the assembly 10.

With the whipstock assembly 10 positioned in the well bore 14, the anchor 12 can be set to secure the whip 22 for the milling process. Hydraulic fluid pressure is supplied from the surface through the running tool and the hydraulic passageway 28 of the whipstock assembly 10 to set the anchor 12. In an embodiment of the anchor 12, slip elements 40 are expanded outwardly in response to the fluid pressure to engage the casing and set the anchor 12. With the anchor 12 set, the mill 16 can be deployed to mill the well bore diversion. In the event a running string 24 was used to run the whipstock assembly 10, the string 24 will be detached and pulled out of the hole in order to run the mill 16. If the mill 16 was used as the running tool, the mill 16 will be detached and run along the diverting surface of the whip 22 to mill the casing. The whipstock assembly 10 will be left in the well bore 14 during subsequent operations.

Figure 6:
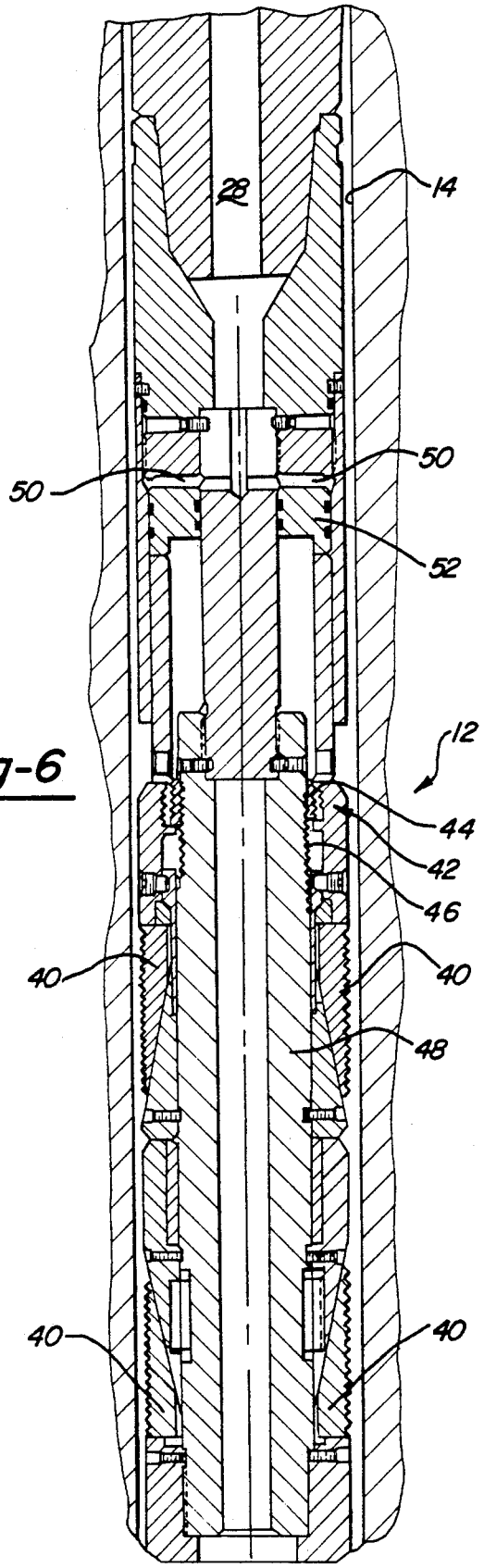
FIG. 6 is a cross-sectional perspective of an embodiment of the anchor incorporated into the whipstock.

Referring now to FIG. 6, there is shown one embodiment of the anchor 12 used to secure the whipstock assembly 10. The anchor 10 is hydraulically set upon introduction of fluid through the passageway 28 and includes mechanical interlock means 42 to prevent release once set. The interlock 42 is in the form of a lock nut 44 which cooperates with a ratchet surface 46 on the inner mandrel 48 to allow relative movement in only one direction. Hydraulic fluid from passageway 28 enters the cylinder 50 applying pressure to piston 52 which in turn affects locking sleeve 54 which carries locking nut 44. The longitudinal shifting in response to the hydraulic pressure will shift the slip assembly to drive the slip elements 40 outwardly into engagement with the cased well bore 14. As a result, the anchor 12 and the whipstock assembly 10 will be set in the well bore 14 to allow milling and diversion of the well.

The foregoing detailed description has been given for clearness of understanding only and no unnecessary limitations should be understood therefrom as some modifications will be obvious to these skilled in the art without departing from the scope and spirit of the appended claims.

What is claimed is:

1. A single-trip whipstock assembly for diverting a well bore for continued production, said assembly comprising:

a hydraulically set anchor selectively non-sealingly engageable with the well bore to secure said assembly within the well;

a whip attached to an upper end of said anchor, said whip including a diverting surface for diverting a cutting tool from said well bore; and means for running said whipstock assembly into said well bore, said means detachably secured to an upper end of said whip and including means for supplying hydraulic fluid to said anchor;

wherein said whipstock assembly is run into the well bore and set within the well bore in a single trip by setting said anchor, said anchor including:

an inner mandrel having a fluid passageway selectively communicating with said hydraulic fluid supply means;

a piston cylinder in fluid communication with said fluid passageway of said mandrel, said cylinder having piston means slidably disposed therein;

a slip assembly mounted to said mandrel, said slip assembly including at least one movable slip cone and a plurality of slip elements selectively expandable into non-sealing anchoring engagement with the well bore upon movement of said at least one movable slip cone, said at least one movable slip cone movable in response to extension of said piston means within said cylinder upon supply of hydraulic fluid to said cylinder; and interlock means for preventing retraction of said slip elements from the cased well bore upon elimination of hydraulic fluid pressure, said interlock means comprising a locking nut having an inner ratchet surface engaging said mandrel and an outer ratchet surface engaging said at last one movable slip cone, said at least one movable slip cone moving in a first direction relative to said mandrel upon supply of hydraulic fluid to set said anchor, said locking nut preventing said at least one movable slip cone from moving in a second direction relative to said mandrel thereby preventing said at least one movable slip cone from moving in a second direction relative to said mandrel thereby preventing release of said anchor upon elimination of hydraulic fluid pressure.

2. The whipstock assembly as defined in claim 1 and further comprising a locator sub for orientating said assembly within the well bore, said locator sub including radially extendable dogs selectively engageable with the cased well bore.

3. The whipstock assembly as defined in claim 2 wherein said locator sub is connected to an upper end of said anchor and a lower end of said whip to be positioned between said anchor and said whip.

4. The whipstock assembly as defined in claim 2 wherein said dogs of said locator sub extend into a window formed in the cased well bore to position said whipstock assembly preventing longitudinal travel of said whipstock.

5. The whipstock assembly as defined in claim 1 wherein said running means includes a running string detachably connected to said whip, said running string having a fluid supply line for supplying hydraulic fluid to set said anchor.

6. The whipstock assembly as defined in claim 1 wherein said running means includes a mill detachably connected to said whip, said mill having a fluid supply line for supplying hydraulic fluid to set said anchor, said mill being detached from said whip upon setting of said anchor and travelling down said whip for milling of the cased well bore.

7. A whipstock assembly for changing the direction of drilling through a cased well bore comprising:

a running string for positioning said whipstock assembly in the cased well bore, said running string having a fluid passageway;

a whipstock detachably connected to said running string;

a hydraulically set anchor connected to said whipstock, said anchor including a fluid passageway, a hydraulically set slip assembly and interlock means for preventing retraction of said slip assembly upon interruption of hydraulic pressure;

fluid passage means for supplying hydraulic fluid from said running string to said fluid passageway of said anchor; and a locator sub connected to said anchor and said whipstock for positioning said whipstock assembly within the well bore, said locator sub including locator dogs selectively expandable into a positioning window formed within the well bore casing;

said anchor set within said well bore upon positioning of said whipstock assembly using said locator sub in engagement with the casing window by supplying hydraulic fluid to said slip assembly to move at least one slip into non-sealing anchoring engagement with the casing, said interlock means allowing movement of said slip assembly to the set position but preventing retraction of said slip assembly upon interruption of hydraulic pressure.

8. The whipstock assembly as defined in claim 7 wherein said anchor further comprises a piston cylinder in fluid communication with said fluid passageway of said anchor, said slip assembly movable into setting engagement with the cased well bore in response to extension of said piston slidably disposed in said cylinder.

9. A whipstock assembly for changing the direction of drilling through a cased well bore comprising:

a mill for forming an opening in the well bore casing;

a whipstock detachably connected to said mill; and a hydraulically set non-sealing anchor connected to said whipstock whereby said assembly can be run into and set within the cased well bore for milling an opening in the casing in one trip of the assembly; said anchor comprising:

an inner mandrel having a fluid passageway selectively communicating with said hydraulic fluid supply means;

a piston cylinder in fluid communication with said fluid passageway of said mandrel, said cylinder having piston means slidably disposed therein;

a slip assembly mounted to said mandrel, said slip assembly including at least one movable slip cone and a plurality of slip elements selectively expandable into non-sealing anchoring engagement with the well bore upon movement of said at least one movable slip cone, said at least one movable slip cone movable in response to extension of said piston means within said cylinder upon supply of hydraulic fluid to said cylinder; and interlock means for preventing retraction of said slip elements from the cased well bore upon elimination of hydraulic fluid pressure, said interlock means comprising a locking nut having an inner ratchet surface engaging said mandrel and an outer ratchet surface engaging said at last one movable slip cone, said at least one movable slip cone moving in a first direction relative to said mandrel upon supply of hydraulic fluid to set said anchor, said locking nut preventing said at least one movable slip cone from moving in a second direction relative to said mandrel thereby preventing said at least one movable slip cone from moving in a second direction relative to said mandrel thereby preventing release of said anchor upon elimination of hydraulic fluid pressure.

10. A whipstock assembly as defined in claim 9 and further comprising a locator sub connected to said anchor and said whipstock for positioning said whipstock assembly within the case well bore.

11. A method of running and setting a whipstock assembly into a cased well bore for changing the direction of a drilling in a single trip, comprising the steps of:

running a whipstock assembly into the cased well bore, said whipstock assembly including a whipstock, a hydraulically set anchor and means for supplying hydraulic fluid to said anchor for setting, said anchor including:

an inner mandrel having a fluid passageway selectively communicating with said hydraulic fluid supply means;

a piston cylinder in fluid communication with said fluid passageway of said mandrel, said cylinder having piston means slidably disposed therein;

a slip assembly mounted to said mandrel, said slip assembly including at least one movable slip cone and a plurality of slip elements selectively expandable into non-sealing anchoring engagement with the well bore upon movement of said at least one movable slip cone, said at least one movable slip cone movable in response to extension of said piston means within said cylinder upon supply of hydraulic fluid to said cylinder; and interlock means for preventing retraction of said slip elements from the cased well bore upon elimination of hydraulic fluid pressure, said interlock means comprising a locking nut having an inner ratchet surface engaging said mandrel and an outer ratchet surface engaging said at last one movable slip cone, said at least one movable slip cone moving in a first direction relative to said mandrel upon supply of hydraulic fluid to set said anchor, said locking nut preventing said at least one movable slip cone from moving in a second direction relative to said mandrel thereby preventing said at least one movable slip cone from moving in a second direction relative to said mandrel thereby preventing release of said anchor upon elimination of hydraulic fluid pressure;

positioning said whipstock assembly within said cased well bore at the location for change of direction;

setting said whipstock assembly by supplying hydraulic fluid through said supplying means to set said anchor within said cased well bore without sealing said well bore, said interlock means preventing release of said anchor upon interruption of hydraulic fluid pressure; and running a mill along said whipstock into engagement with the cased well bore to mill an aperture in said casing to facilitate changing the direction of drilling from the cased well bore.

12. The method as defined in claim 11 wherein said mill is detachably connected to said whipstock, said mill being detached from said whipstock prior to running said mill along said whipstock, said means for supplying hydraulic fluid to said anchor being severed upon detachment of said mill thereby interrupting fluid supply to said anchor.

13. The method as defined in claim 12 further comprising cutting a window in said cased well bore prior to running said whipstock assembly, said whipstock assembly including a locator sub having selectively expandable dogs.

14. The method as defined in claim 13 wherein the step of positioning said whipstock assembly includes running said whipstock assembly until said locator sub aligns with said casing window allowing said dogs to expand into said window preventing longitudinal movement of said whipstock assembly.

* * * * *